US005377477A

United States Patent [19]

Haberstroh et al.

[11] Patent Number: 5,377,477

[45] Date of Patent: Jan. 3, 1995

[54] METHOD AND APPARATUS FOR A POWER STRAPPING MACHINE

[75] Inventors: James A. Haberstroh, Vernon Hills; Timothy B. Pearson, Antioch, both of Ill.

[73] Assignee: Signode Corporation, Glenview, Ill.

[21] Appl. No.: 164,450

[22] Filed: Dec. 9, 1993

[51] Int. Cl.[6] ..... B65B 13/22; B65B 13/04

[52] U.S. Cl. ..... 53/399; 53/589; 53/389.4; 100/3; 100/29; 100/32

[58] Field of Search ..... 53/399, 589, 389.4; 100/2, 3, 29, 32

[56] References Cited

U.S. PATENT DOCUMENTS

| | | | |
|---|---|---|---|
| 3,232,217 | 2/1966 | Harmon et al. . | |
| 3,470,814 | 10/1969 | Tschappu . | |
| 3,536,430 | 10/1970 | Kurihara . | |
| 3,648,739 | 3/1972 | Angarola . | |
| 3,654,033 | 4/1972 | Angarola et al. . | |
| 4,001,064 | 1/1977 | Nix . | |
| 4,015,643 | 4/1977 | Cheung . | |
| 4,041,993 | 8/1977 | Angarola . | |
| 4,080,082 | 3/1978 | Angarola . | |
| 4,177,724 | 12/1979 | Johnson, III et al. . | |
| 4,282,907 | 8/1981 | Massion et al. . | |
| 4,289,174 | 9/1993 | Massion . | |
| 4,289,175 | 9/1981 | Crittenden et al. . | |
| 4,559,767 | 12/1985 | Takami | 53/589 |
| 4,724,659 | 2/1988 | Mori et al. | 53/589 |
| 4,885,901 | 12/1989 | Sakaki et al. . | |
| 4,910,945 | 3/1990 | Fujii et al. | 53/589 |
| 4,912,908 | 4/1990 | Sakaki | 53/589 |
| 4,912,912 | 4/1990 | Tagomori . | |
| 4,955,180 | 9/1990 | Sakaki et al. | 53/589 X |
| 5,083,412 | 1/1992 | Sakaki et al. | 53/589 X |
| 5,155,982 | 10/1992 | Boek et al. | 100/29 X |
| 5,203,541 | 4/1993 | Nix . | |
| 5,299,407 | 4/1994 | Schuttler et al. | 53/589 X |

*Primary Examiner*—Horace M. Culver

*Attorney, Agent, or Firm*—Thomas W. Buckman; Donald J. Breh

[57] ABSTRACT

A novel method and apparatus for feeding and tensioning a strap in a power strapping machine. The apparatus includes a strap feeding mechanism, a strap tensioning mechanism, and a pivoting roller carriage pivoted by a feeding and tensioning cam. The pivoting roller carriage first actuates the strap feeding mechanism to engage a portion of a strap and feed the strap toward a strap application assembly where the strap is formed in a loop about an object or group of objects. The strap feeding and tensioning mechanism actuates a first gripper that secures an end of the strap in the strap application assembly. The pivoting roller carriage then actuates the strap tensioning mechanism to engage a portion of the strap and apply a tension to the looped strap. The strap feeding and tensioning apparatus also actuates a second gripper that secures the tensioned strap in a closed loop about the package so that the strap application assembly may form a strap joint sealing the strap in the closed loop. In the event that the strap is not properly engaged by the first gripper, the strap will be fully retracted from the strap application assembly by the strap tensioning mechanism and the strap will be directed into a strap stretch-out housing where it will remain until the strap feeding mechanism again engages a portion of the strap and re-feeds the strap toward the strap application assembly. The weight and position of the strap disposed in the strap stretch-out housing prevents the strap from withdrawing entirely from the strap feeding mechanism thereby ensuring that the strap feeding mechanism will engage and re-feed the strap to the strap application assembly automatically.

10 Claims, 3 Drawing Sheets

METHOD AND APPARATUS FOR A POWER STRAPPING MACHINE

FIELD OF THE INVENTION

The present invention relates to a novel method and apparatus for feeding and tensioning a strap in a power strapping machine. Specifically, the invention relates to a novel strap feeding and tensioning apparatus that feeds a steel or polymeric strap to a strap application assembly where the strap is formed in a sealed tensioned loop about a package. The invention also relates to a novel feeding and tensioning apparatus that automatically re-feeds a strap to a strap application assembly in the event that the strap is not properly fed to the strap application assembly in the first instance.

BACKGROUND OF THE INVENTION

Strapping machines apply a steel or polymeric strap in a sealed tensioned loop about a package to securely bind the package for shipping, storage and merchandising. Automatic strapping machines generally comprise an automatic strap feeding mechanism that initially feeds a strap to a strap application assembly comprising an annular channel where the strap is formed in a loop which surrounds a package to be bound. An automatic strap tensioning mechanism then applies a tension to the strap so that the strap application assembly may form a strap seal to securely bind the package. Steel straps are typically sealed with a metal clip and polymeric straps are typically sealed by a weld formed with a healed blade or by friction. It has been suggested to feed a strap to a strap application assembly by frictionally engaging the strap between a pair of counter-rotating rollers rotated by a motor driven shaftjournaled to a frame. Likewise, it has also been suggested to apply a tension to a strap by frictionally engaging the strap between a pair of counter-rotating rollers that draw the strap in a light loop about the package. For example, U.S. Pat. No. 3,232,217 to Itarmon el al. discloses a strap feeding and tensioning mechanism comprising two pair of counter-rotating rollers mounted on a bracket that may be positioned to frictionally engage a strap for feeding or tensioning the strap in a strap application assembly. Automatic strapping machines frequently encounter problems feeding the strap to the strap application assembly. For instance, the strap may not properly feed along the annular channel or the strap may not be securely retained by the strap application assembly during tensioning of the strap. A strap not properly fed to the strap application assembly or a strap not securely retained by the strap application assembly during tensioning of the strap must be retracted from the strap application assembly and then re-fed by the strap feeding mechanism. Known strap feeding and tensioning mechanisms also have the disadvantage that they subject the strap to considerable mechanical stress that may result in breakage of the strap during application of the strap or during handling of the bound package. Mechanical stress is not limited to the strap but also to the strap feeding and particularly the strap tensioning mechanism which may be subject to considerable frictional forces during feeding and tensioning of the strap. There exists therefore a demonstrated need for an advancement in the art of feeding and tensioning a strap in a strapping machine.

It is an object of the present invention to provide a novel strap feeding and tensioning apparatus.

it is also an object of the present invention to provide a novel strap feeding and tensioning apparatus the automatically re-feeds a strap not properly fed to a strap application assembly in the first instance.

It is also an object of the invention to provide a novel strap feeding and tensioning apparatus that is economical to manufacture and operate.

It is another object of the invention to provide a novel strap feeding and tensioning apparatus that minimizes damage to a strap during feeding and tensioning of the strap.

It is a further object of the invention to provide a novel strap feeding and tensioning apparatus having a cam actuated feed roller that feeds the strap to a strap application assembly.

It is a farther object of the invention to provide a novel strap feeding and tensioning apparatus having a cant actuated tensioning roller that applies a fixed or variable tension on the strap after the strap is formed in a loop in a strap application assembly.

It is a further object of the present invention to provide a novel strap feeding and tensioning apparatus that reduces an amount of energy required to feed and apply tension to the strap.

It is yet a further object off the invention to provide a novel strap feeding and tensioning apparatus that reduces stress on the feeding and tensioning apparatus and thereby increases the reliability and lifetime of the strap feeding and tensioning apparatus.

Accordingly, the present invention is directed toward a novel method and apparatus for feeding and tensioning a strap in a power strapping machine. The apparatus includes a strap feeding mechanism, a strap tensioning mechanism, and a pivoting roller carriage having a cam follower. The strap feeding mechanism is comprised of a fixed feed drive roller and a feed follow roller disposed on the pivoting roller carriage. The strap tensioning roller is comprised of a fixed tension drive roller and a tension follow roller also disposed on the pivoting roller carriage. The pivoting roller carriage is pivoted by a feeding and tensioning cant having a feed phase surface and a tension phase surface. The feed phase surface engages the cam follower and pivots the pivoting roller carriage to actuate the strap feeding mechanism to engage a portion of a strap and feed the strap toward a strap application assembly where the strap is formed in a loop about a package. The strap feeding and tensioning mechanism actuates a first gripper that secures an end of the strap in the strap application assembly. The tension phase surface of the cam then engages the cam follower and pivots the pivoting roller carriage to actuate the strap tensioning mechanism to engage a portion of the strap and apply a tension to the looped strap. The strap feeding and tensioning apparatus also actuates a second gripper that secures the tensioned strap in a closed loop about the package so that the strap application assembly may form a strap joint sealing the strap in the closed loop. The apparatus automatically re-feeds a strap to the strap application assembly if the strap is not properly secured by the first gripper in the first instance. More specifically, the apparatus includes a strap stretch-out housing that receives strap retracted from the strap application assembly when the strap tensioning mechanism applies a tension to the strap. In the event that the strap is not properly engaged by the first gripper, the strap will be fully retracted from the strap application assembly and the strap will be directed into the strap stretch-out housing where it will remain until the feeding surface again engages the cam follower and pivots the pivoting roller carriage to actuate the strap feeding mechanism to engage a portion of the strap and re-feed the strap toward the strap application assembly. The weight and position of the strap disposed in the strap stretch-out housing prevents the strap from entirely withdrawing from the strap feeding mechanism, thereby ensuring that the strap feeding mechanism will engage and re-feed the strap to the strap application assembly.

These and other objects, features and advantages of the present invention will become apparent upon consideration of the following Detailed Description of the Invention with the accompanying drawings.

DETAILED DESCRIPTION OF THE INVENTION

Figure 1:
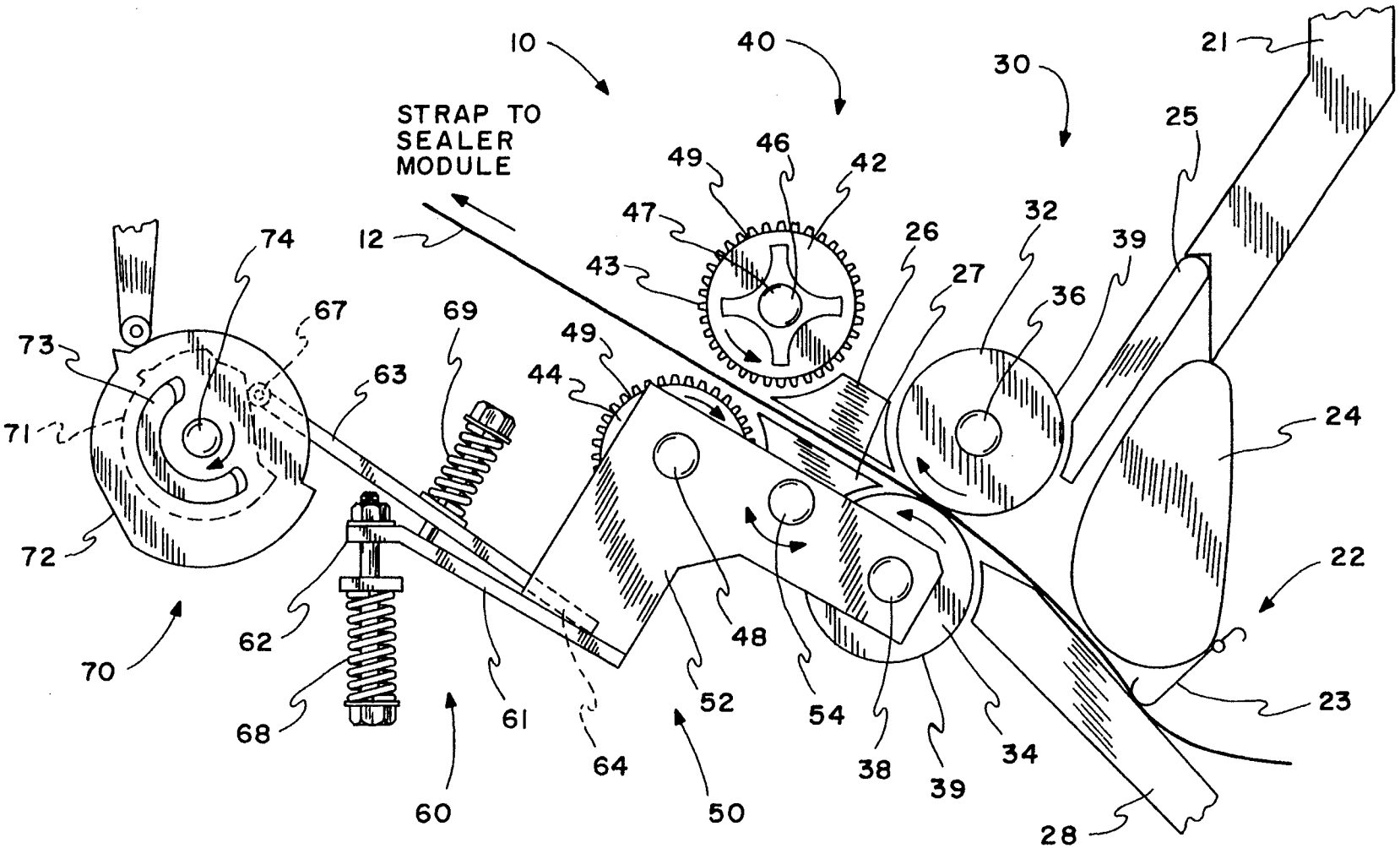
FIG. 1 is a side view of the strap feeding and tensioning apparatus in a strap feeding configuration.
Figure 2:
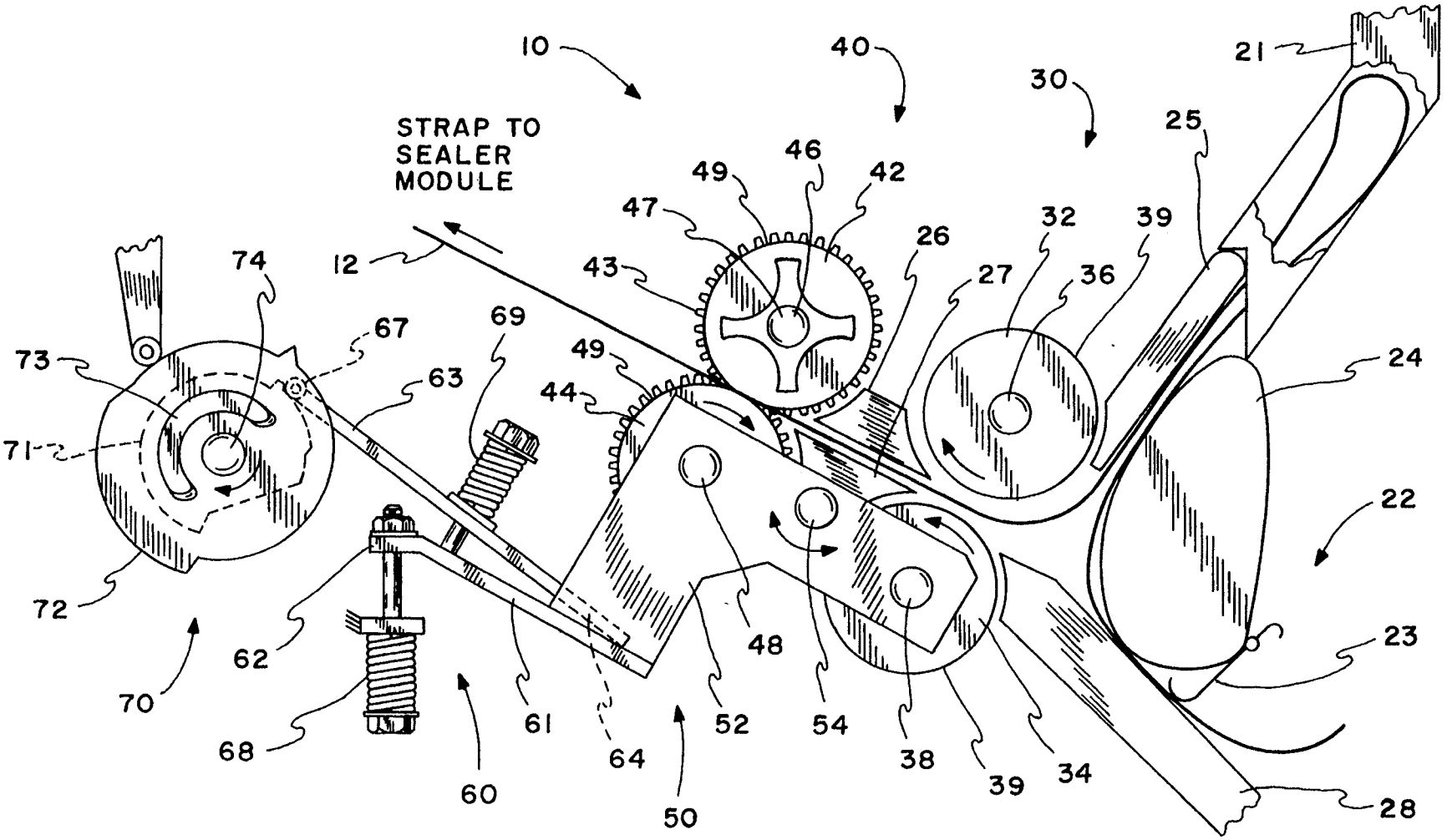
FIG. 2 is a side view of the strap feeding and tensioning apparatus of FIG. 1 in a strap tensioning configuration.
Figure 3:
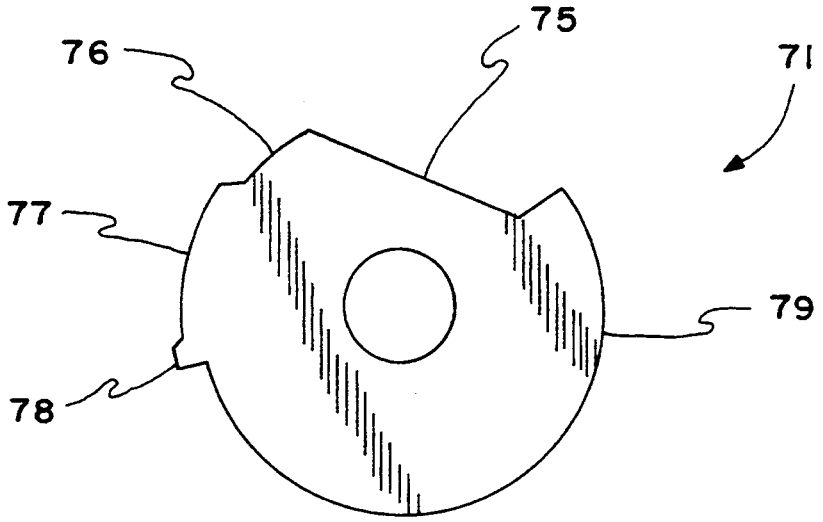
FIG. 3 is a side view of a strap feeding and tensioning cam.
Figure 4:
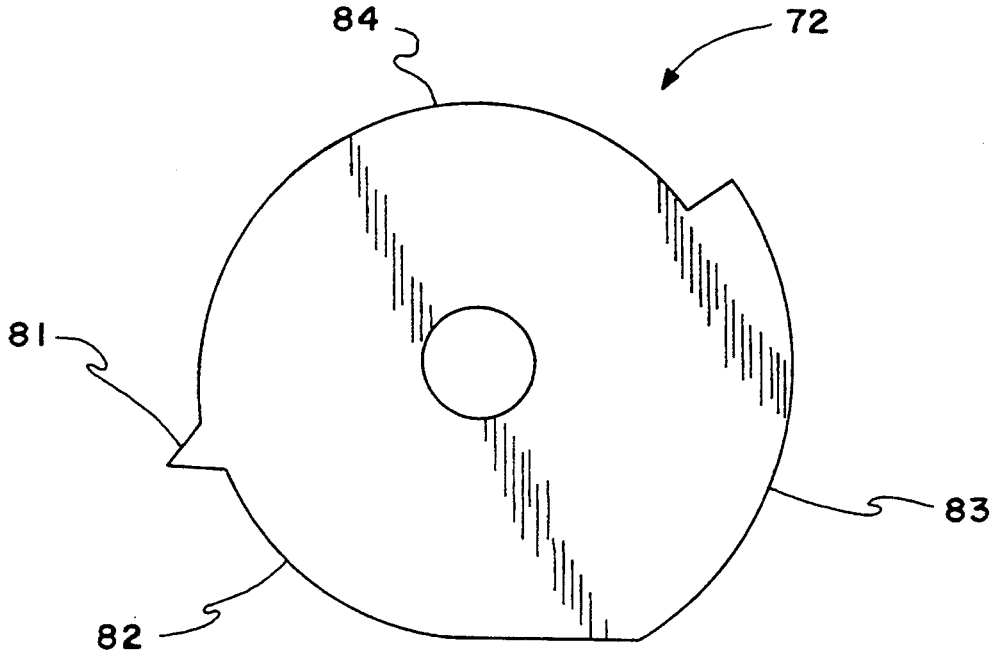
FIG. 4 is a side view of a gripping cam.

FIG. 1 is a perspective view of a novel strap feeding and tensioning apparatus 10 for feeding and tensioning a strap 12 supplied from a strap supply assembly to a strap application assembly that applies the strap 12 in a tensioned, closed loop about a package. The strap 12 may be a steel strap or a polymeric strap which may have a textured surface. The strap application assembly, package, and strap supply assembly are not illustrated in the Drawings.

The novel strap feeding and tensioning apparatus 10 of the present invention generally comprises a frame 20, a strap feeding mechanism 30, a strap tensioning mechanism 40, a pivoting roller carriage 50, a carriage lever arm 60, a cam assembly 70 and a power drive train assembly that may be operated by a foot actuated switch neither of which are shown in the Drawings. The strap feeding mechanism 30 comprises a feed drive roller 32 and a feed follow roller 34. The feed drive roller 32 is rotatably driven in a clockwise direction by a feed drive shaft 36 both of which are fixedly mounted on the frame 20. The feed follow roller 34 is rotatable on a shaft 38 and may be driven in counter-rotation by the feed drive roller 32 as discussed below. The feed drive roller 32 and the feed follow roller 34 each have a roller peripheral surface 39 that is preferably as wide as the strap 12. The roller peripheral surfaces 39 may also be textured to increase contact friction with a portion of the strap 12. The strap tensioning mechanism 40 comprises a tension drive roller 42 and a tension follow roller 44. The tension drive roller 42 is rotatably driven in a counter-clockwise direction by a tension drive shaft 46 both of which are fixedly mounted on the frame 20. The tension drive roller 42 may alternatively be coupled to the tension drive shaft 46 by a clutch 47 to permit slippage of the tension drive roller 42 relative to the tension drive shaft 46. A similar clutch arrangement may also be used on the strap feeding mechanism 30. The tension follow roller 44 is rotatable on a shaft 48 and may be driven in counter-rotation by the tension drive roller 42 as discussed below. The tension drive roller 42 and the tension follow roller 44 each have a roller peripheral surface 49 that is preferably as wide as the strap 12. The roller peripheral surfaces 49 may also be textured to increase contact friction with a portion of the strap 12. The tension drive roller 42 and the tension follow roller 44 may also include complementary gear teeth 43 and 45, respectively, enabling the tension drive roller 42 to engage and rotate the tension follow roller 44 in a counter-rotating direction. Similar complimentary gear teeth may also be used on the strap feeding mechanism 30. The feed drive shaft 36 and the tension drive shaft 46 are driven in rotation by the power drive train assembly.

The pivoting roller carriage 50 comprises a pivoting roller bracket 52 that is pivotally fastened to the frame 20 by a pivoting member 54 as is known in the art. The feed follow roller 34 and the tension follow roller 44 are each rotatably disposed on the pivoting roller bracket 52 by the shaft 38 and the shaft 48, respectively. The pivoting member 54 and, accordingly, the pivot point of the pivoting roller bracket 52 are located between the feed follow roller 34 and the tension follow roller 44. The pivoting roller carriage 50 also comprises a carriage lever arm 60 having a first lever arm 61 and a second lever arm 63. The first lever arm 61 extends from the roller bracket 52 and terminates at a distal end 62. The second lever arm 63 has a base end 64 pivotally disposed in a slot in the roller bracket 52. A cam follower 67 is disposed at a distal end 65 of the second lever arm 63. The first lever arm 61 is coupled to the frame 20 by a first spring 68 disposed near the distal end 62 of the first lever arm 61. The second lever arm 63 is coupled to the first lever arm 61 by a second spring 69. The first spring 68 biases the first lever arm 61 to pivot the pivoting roller bracket 52 in a counter-clockwise direction so that the cant follower 67 engages the feeding and tensioning cam 71. The second spring 69 biases the second lever arm 63 toward the first lever arm 61 to engage the cam follower 67 with the feeding and tensioning cant 71 and to bias the second lever arm 63 toward the first lever arm 61. The first spring 68 and the second spring 69 also provide a damping effect when the pivoting roller carriage 52 is pivoted to engage the strap feed mechanism 30 and the strap tension mechanism 40 as discussed below.

The cam assembly 70 comprises a feeding and tensioning cam 71, a gripping cam 72, and a face cam 73 all of which are rotatably disposed on a cam shaft 74 fixedly disposed relative to the frame 20. The feeding and tensioning cam 71 has a feed phase surface 75, a first neutral phase surface 76, a low tension phase surface 77, and a high tension phase surface 78, and a second neutral phase surface 79. The feeding and tensioning cam may however have only a single tensioning surface. The gripping cam 72 includes a strap end grip surface 81, a first neutral surface 82, a loop grip surface 83, and a second neutral surface 84. The cam shaft 74 is driven in rotation by the power drive train assembly not shown in the drawings.

The frame 20 comprises a base and a housing neither of which are shown in the Drawings, a strap stretch-out housing 21 for retaining a portion of the strap 12 during feeding and tensioning of the strap 12, a strap infeed guide 28, and a one-way strap guide 22 having a spring clip 23 biased against the strap infeed guide 28. The spring clip 23 is biased to permit the strap 12 to be drawn from the strap supply assembly and fed between the spring clip 23 and the strap infeed guide 28 toward the strap feeding mechanism 30. The frame 20 may also comprise a first vertical strap guide 24 and a second vertical strap guide 25 for guiding the strap 12 between the stretch-out housing 21 and the strap feeding mechanism 30. The frame 20 may also comprise an upper strap guide 26 and a lower strap guide 27 disposed between the strap feeding mechanism 30 and the strap tensioning mechanism 40 for guiding the strap 12 therebetween as discussed below.

Generally, the feeding and tensioning apparatus 10 operates in a cycle that feeds a strap 12 supplied from the strap supply assembly to the strap application assembly where the strap 12 is looped around a package. The strap application assembly then secures an end of the strap 12 with a strap end gripper not shown in the drawing so that the feeding and tensioning apparatus 10 may apply a tension to the strap 12. The strap application assembly secures the strap in a tensioned, closed loop about the package with a loop gripper not shown in the drawings. The strap application assembly then forms a joint to the tensioned, closed loop strap 12 and severs the strap from the feeding and tensioning apparatus 10. The strap joint may be formed by application of a clip around a steel strap or by heat sealing a polymeric strap with a heated blade or by friction as is known in the art. The cycle is then repeated.

During the strap feeding portion of the cycle, the feed phase surface 75 of the feeding and tensioning cam 71 engages the cam follower 67 to pivot the roller bracket 52 in a counter-clockwise direction to position the peripheral surface 39 of the feed follow roller 34 near the peripheral surface 39 of the feed drive roller 32 defining a space therebetween so that a portion of the peripheral surface 39 of the feed drive roller 32 and a portion of the peripheral surface 39 of the feed follow roller 34 may contact and frictionally engage a portion of the strap 12 disposed in the space between the feed drive roller 32 and the feed follow roller 34. The relative positioning of the feed drive roller 32 and the feed follow roller 34 is damped by the first spring 68 and the second spring 69 so that the strap 12 is not damaged during contact with the feed drive roller 32 and the feed follow roller 34. As the feed drive roller 32 and the feed follow roller 34 contact and frictionally engage the portion of the strap 12 disposed in the space therebetween, the strap 12 is drawn from the strap supply assembly through the one-way strap guide 22 toward the strap feeding mechanism 30. A portion of the strap 12, however, may reside within the strap stretch-out housing 21 and therefore the strap feeding mechanism 30 may first draw a portion of the strap 12 from within the stretch-out housing 21, between the first vertical strap guide 24 and the second vertical strap guide 25, into the space between the feed drive roller 32 and the feed follow roller 34 and thereafter between the upper feed guide 26 and the lower feed guide 27, and through the strap tensioning mechanism 40 toward the strap application assembly where the strap is formed in a loop about a package. The strap tensioning mechanism 40 does not engage the strap 12 while the feed phase surface 75 of the feeding and tensioning cam 71 engages the cam follower 67. During feeding of the strap 12, slippage may occur between the strap 12 and the strap feeding mechanism 30 thereby damaging the strap 12. The slippage and resulting damage to the strap 12 may be avoided by employing a clutch between the feed drive roller 32 and the feed drive shaft 36 so that the feed drive roller 32 slips relative to the feed drive shaft 36 rather then relative to the strap 12. The strap feeding mechanism 30 feeds a fixed amount of strap to the strap application assembly determined by a period of time during which the feed phase surface 75 of the feeding and tensioning cam 71 engages the cam follower 67 and pivots the roller bracket 52 to actuate the strap feeding mechanism 30 to engage the strap 12.

After the strap 12 has been formed in a loop about a package by the strap application assembly, the first neutral phase surface 76 of the feeding and tensioning cam 71 engages the cam follower 67 during which time the pivoting bracket 52 is pivoted in a clockwise direction so that neither the strap feeding mechanism 30 nor the strap tensioning mechanism 40 substantially contact or engage the strap 12. The strap end grip surface 81 of the gripper cam 72 then actuates a strap end gripper in the strap application assembly that grips an end of the strap 12 formed in a loop around the package.

During the strap tensioning portion of the cycle, the low tension phase surface 77 of the feeding and tensioning cam 71 engages the cam follower 67 to pivot the roller bracket 52 clockwise to position the peripheral surface 49 of the tension follow roller 44 near the peripheral surface 49 of the tension drive roller 42 leaving a space therebetween so that a portion of the peripheral surface 49 of the tension drive roller 42 and a portion of the peripheral surface 49 of the tension follow roller 44 may contact and frictionally engage a portion of the strap 12 disposed in the space therebetween. The relative positioning of the tension drive roller 42 and the tension follow roller 44 is damped by the first spring 68 and the second spring 69 so that the strap 12 is not damaged during contact with the tension drive roller 42 and the tension follow roller 44. The strap tensioning mechanism 40 first withdraws excess strap from the strap application assembly to form the strap 12 in a loop under low tension around the package. Then, during the high tension phase of the cycle, the high tension phase surface 78 of the feeding and tensioning cam 71 pivots the roller bracket 52 still further in the clockwise direction to apply a high tension to the strap 12. In an alternative embodiment, the feeding and tensioning cam 71 may have only a single tensioning surface thereby applying a constant tension to the strap 12 during the tensioning phase of the cycle.

During the tensioning phase of the cycle, the strap is withdrawn from the strap application assembly and directed back between the upper strap guide 26 and the lower strap guide 27, through the strap feeding mechanism 30, between the first vertical strap guide 24 and the second vertical strap guide 25, and into the strap stretch-out housing 21. After a predetermined tension is applied to the strap 12 by the tensioning apparatus 40, the strap 12 slips between the tension drive roller 42 and the tension follow roller 44 during the remaining portion of the tension phase of the cycle. The clutch 47 may be used to decrease slippage of the strap 12 between the tension drive roller 42 and the tension follow roller 44. The tension applied to the strap 12 depends on the frictional force applied to the strap 12 by the tension drive roller 42 and the tension follow roller 44 and may be varied by adjusting the spacing between the rollers or by adjusting a slippage of the clutch 47. The strap tensioning mechanism 40 applies a tension to the strap for a period of time during which the tension phase surfaces 77 and 78 of the feeding and tensioning cam 71 engages the cam follower 67 and pivot the roller bracket 52 to actuate the strap tensioning mechanism 40 to engage the strap 12. If there is no package in the strap application assembly, then the strap tensioning mechanism 40 will fully retract the strap 12 therefrom. If the strap 12 is looped about a package, the strap tensioning assembly will first apply a tension to the strap determined by the friction applied to the strap as discussed above after which time the strap will slip between he tension drive roller 42 and the tension follow roller 44. The time during which slippage of the strap 12 in the strap tensioning mechanism 40 occurs depends on the size of the package about which the strap is disposed.

In the event that the end of the strap 12 is not secured by the strap end gripper in the strap application assembly, the strap 12 may be fully retracted from the strap application assembly and disposed in the strap stretch-out housing 21 by the tensioning mechanism 40 during the strap tensioning phase of the cycle. The weight and position of the portion of the strap 12 in the stretch-out housing 21 will prevent the strap 12 from being fully retracted from between the feed drive roller 32 and the feed follow roller 34 of the strap feeding mechanism 30, thereby enabling the strap feeding mechanism 30 to re-engage and feed the strap 12 during the next strap feeding phase of the cycle. Also, the spring clip 22 prevents the strap 12 from withdrawing from the apparatus 10 and moving back toward the strap supply assembly, by pinching the strap 12 the between the spring clip 22 and the strap inlet guide 28.

The loop grip surface 83 of the gripping cam 72 actuates a strap loop gripper that secures the strap 12 in a tensioned, closed loop about the package while a tension is applied to the strap 12 by the strap tensioning mechanism 40. The second neutral surface 79 of the feeding and tensioning cam 71 then engages the cam follower 67 and pivots the roller carriage 52 to disengage the strap 12 from the strap feeding mechanism 30 and the strap tensioning mechanism 40. Subsequently, the strap application assembly forms the strap joint securing the closed strap loop about the package and severs the strap from the strap feeding and tensioning apparatus 10 while the strap loop gripper holds the strap in a tensioned loop about the package. After the strap joint has been formed and the strap has been severed, the second neutral surface 83 of the gripping cam 72 de-actuates both the strap end gripper and the strap loop gripper so that the package may be removed from the strap application assembly. The face cam 73 then momentarily displaces a housing cover not shown in the drawing so that the sealed strap may be removed from the strap gripper when the bound package is removed from the strap application assembly. The cycle then repeats.

The foregoing description will enable one of ordinary skill in the art to make and use the preferred embodiments of the present invention. It will be appreciated by those skilled in the art that variations, modifications and equivalents to the embodiments disclosed herein exist. The present invention therefore is to be limited only by the scope of the appended claims.

What is claimed is:

1. A strap feeding and tensioning apparatus for a strapping machine, the apparatus comprising:

a pivoting roller carriage pivotally disposed relative to a frame;

a first strap feeding roller drivable by a first rotatable drive shaft, the first rotatable drive shaft rotatable by a power drive train;

a second strap feeding roller adjacent the first strap feeding roller and rotatably disposed on the pivoting roller carriage;

the first and second strap feeding rollers positionable to engage between them and feed a strap to a strap application assembly;

a first strap tensioning roller drivable by a second rotatable drive shaft, the second rotatable drive shaft rotatable by a power drive train;

a second strap tensioning roller rotatably disposed on the pivoting roller carriage;

the first and second strap tensioning rollers positionable to engage between them and tension a strap around an object; and a feeding and tensioning cam rotatably disposed with respect to the frame, the feeding and tensioning cam engageable with a cam follower on the pivoting roller carriage, the pivoting roller carriage being pivotable about a pivot point disposed between the second feeding and tensioning rollers, by the action of the feeding and tensioning cam against the cam follower, wherein rotation of the roller carriage by the cam in a first direction separates the tensioning rollers and draws the feeding rollers together to engage and feed the strap, and rotation of the roller carriage by the cam in a second direction separates the feeding rollers and draws the tensioning rollers together to apply tension to the strap.

2. The apparatus of claim 1 wherein the feeding and tensioning cam comprises:

a feeding surface engageable with the cam follower, the roller carriage pivotable frown the action of the feeding surface to move the second strap feeding roller toward the first strap feeding roller to engage the strap disposed between the first strap feeding roller and the second strap feeding roller and feed the strap to a strap application assembly;

a first neutral surface disposed adjacent the feeding surface;

a low tensioning surface disposed adjacent the first neutral surface, the low tensioning surface engageable with the cam follower, the roller carriage pivotable from the action of the low tensioning surface to move the second strap tensioning roller toward the first strap tensioning roller to engage the strap disposed between the first strap tensioning roller and the second strap tensioning roller and apply a first tension to the strap fed to the strap application assembly;

a high tensioning surface disposed adjacent the low tensioning surface, the high tensioning surface engageable with the cam follower, the roller carriage pivotable from the action of the high tensioning surface to move the second strap tensioning roller toward the first strap tensioning roller to engage the strap disposed between the first strap tensioning roller and the second strap tensioning roller and apply a second tension, greater than the first tension, to the strap fed to the strap application assembly; and a second neutral surface disposed between the high tensioning surface and the feeding surface.

3. The apparatus of claim 2 further comprising:

a first lever arm having a first end and a second end, the first end of the first lever arm coupled to the pivoting roller carriage;

a second lever arm having a first end and a second end, the first end of the second lever arm coupled proximate to the first end of the first lever arm, the cam follower being disposed on the second end of the second lever arm;

a first spring coupling the first lever arm and the frame, the first spring applying a force on the first lever arm to bias the pivoting roller carriage to move the second strap feeding roller toward the first strap feeding roller; and a second spring coupling the second lever arm and the first lever arm, the second spring applying a force on the second lever arm to bias the second lever arm toward the first lever arm wherein the second spring dampens an over-travel of the second lever arm when the cam engages the cam follower and pivots the pivoting roller carriage to move the second strap tensioning roller toward the first strap tensioning roller.

4. The apparatus of claim 3 further comprising a strap stretch-out housing disposed relative to the frame and extending above the first strap feeding roller and the second strap feeding roller, wherein a portion of a strap extended up into the strap stretch-out housing applies a force on the strap that prevents the strap from withdrawing from between the first strap feeding roller and the second strap feeding roller.

5. The apparatus of claim 4 further comprising a first vertical strap feed guide fixedly disposed relative to the frame, and a one-way strap guide disposed relative to the frame, the one-way strap feed guide preventing the strap from retracting entirely from the strap feeding and tensioning apparatus, whereby the need for rethreading the tape after a misfeed is avoided.

6. The apparatus of claim 5 further comprising a gripping cam rotatable by a rotatable cam shaft, the gripping cam having a strap end grip surface for actuating a strap end gripper, a loop grip surface for actuating a strap loop gripper, and a face cam rotatable by the rotatable cam shaft, the face cam arranged and constructed to displace a housing of the strap feeding and tensioning apparatus for removal of a strapped object.

7. A method for feeding and tensioning a strap in an apparatus having a first strap feeding roller, a first strap tensioning roller, and a pivoting roller carriage pivotally disposed relative to the frame, the pivoting roller carriage having a cam follower, a second strap feeding roller rotatably disposed thereon and a second strap tensioning roller rotatably disposed thereon, wherein the pivoting roller carriage has a pivot point between the second strap feeding roller and the second strap tensioning roller, the method comprising the steps of:

engaging the cam follower with a rotating cam and pivoting the pivoting roller carriage to separate the first strap tensioning roller from the second strap tensioning roller, and to move the second strap feeding roller toward the first strap feeding roller, thereby engaging the strap disposed between the first strap feeding roller and the second strap feeding roller and feeding the strap toward a strap application assembly; and engaging the cam follower with a rotating cam and pivoting the pivoting roller carriage to move the second strap tensioning roller toward the first strap tensioning roller, thereby engaging the strap disposed between the first strap tensioning roller and the second strap tensioning roller, and applying a first tension to the strap fed to the strap application assembly.

8. The method of claim 7 further comprising a step of engaging the cam follower with a rotating cam and pivoting the pivoting roller carriage to separate the first strap feeding roller from the second strap feeding roller, and to move the second strap tensioning roller toward the first strap tensioning roller, thereby engaging the strap disposed between the first strap tensioning roller and the second strap tensioning roller and applying a second tension, greater than the first tension, to the strap fed to the strap application assembly.

9. The method of claim 8 further comprising steps of:

engaging the cam follower with a single cam having a feeding surface that engages the cam follower and pivots the pivoting roller carriage to move the second strap feeding roller toward the first strap feeding roller, resiliently biasing the first feeding roller towards the second feeding roller, engaging the strap disposed between the first strap feeding roller and the second strap feeding roller to feed the strap to the strap application assembly, engaging the cam follower with a low tensioning surface of the cam and pivoting the roller carriage to move the second strap tensioning roller toward the first strap tensioning roller, engaging the strap disposed between the first strap tensioning roller and the second strap tensioning roller, applying a first tension to the strap fed to the strap application assembly, engaging the cam follower with a high tensioning surface of the cam and pivoting the roller carriage to move the second strap tensioning roller toward the first strap tensioning roller, engaging the strap disposed between the second tensioning roller and the first tensioning roller, and applying a second tension, greater than the first tension, to the strap fed to the strap tensioning apparatus.

10. The method of claim 8 further comprising steps of:

directing a portion of the strap into a stretch-out housing as the first strap tensioning roller and the second strap tensioning roller apply a tension to the strap, the portion of the strap in the stretch-out housing applying a force on the strap which prevents the strap from withdrawing entirely from between the first strap feeding roller and the second strap feeding roller, thereby eliminating the need to rethread the strap into the feed rollers.

* * * * *